US006162489A

United States Patent [19]

Buecher et al.

[11] Patent Number: 6,162,489

[45] Date of Patent: Dec. 19, 2000

[54] PRODUCTION OF STRIPED COATINGS ON STRIP

[75] Inventors: Udo Wolfgang Buecher, Farmborough Heights; Trevor James Horton, Albion Park; Mark John Davies, Albion Park Rail, all of Australia

[73] Assignee: BHP Steel (JLA) Pty Ltd, New South Wales, Australia

[21] Appl. No.: 09/147,840

[22] PCT Filed: Sep. 25, 1997

[86] PCT No.: PCT/AU97/00637

§ 371 Date: Mar. 17, 1999

§ 102(e) Date: Mar. 17, 1999

[87] PCT Pub. No.: WO98/13145

PCT Pub. Date: Apr. 2, 1998

[30] Foreign Application Priority Data

Sep. 25, 1996 [AU] Australia ..... PO2570

[51] Int. Cl.[7] ..... B05D 3/12; B05C 11/02

[52] U.S. Cl. ..... 427/11; 427/286; 427/287; 427/314; 427/318; 427/359; 427/365; 118/68; 118/77; 118/118; 118/119

[58] Field of Search ..... 118/118, 119, 118/68, 77; 427/286, 359, 314, 318, 287, 11, 365

[56] References Cited

U.S. PATENT DOCUMENTS

| | | | |
|---|---|---|---|
| 4,002,780 | 1/1977 | Reade et al. . | |
| 4,344,989 | 8/1982 | Thornton et al. | 427/286 |
| 5,281,435 | 1/1994 | Buecher | 118/118 |
| 5,407,697 | 4/1995 | Buecher et al. | 427/11 |

FOREIGN PATENT DOCUMENTS

| | | |
|---|---|---|
| 37044/78 | 12/1979 | Australia . |
| 41527/93 | 1/1994 | Australia . |
| 494 672 A1 | 7/1992 | European Pat. Off. . |
| 9-099264 | 4/1997 | Japan . |

OTHER PUBLICATIONS

Derwent Accession No. 69270B/38, class M 13, JP 79–025 538 (Daido Kohan KK (NIPA)) Aug. 29, 1979.

*Primary Examiner*—Katherine A. Bareford

*Attorney, Agent, or Firm*—Miles & Stockbridge P.C.; John C. Kerins

[57] ABSTRACT

An apparatus and method for producing a striped coating on a continuously moving strip are provided, in which the apparatus has a smoothing device including a doctor roll forming a nip with the strip. A stationary partition means is provided, which divides the nip into nip lengths, and upstream of the smoothing device is a means to deposit coating materials on the strip for delivery into the respective nip lengths at predetermined rates. The deposit means maintains a bead of coating material in each nip length and a stripe of coating material is formed on the strip from coating material escaping the respective nip length as the strip passes through the nip.

24 Claims, 4 Drawing Sheets

PRODUCTION OF STRIPED COATINGS ON STRIP

This application is a National Stage application of PCT Application No. PCT/AU97/00637, filed Sep. 25, 1997.

TECHNICAL FIELD

This invention relates to a method and apparatus for the continuous application of liquid or semi-liquid coatings to a moving substrate strip.

The invention has been developed primarily for the application of coatings of paint to substrates of metal strip, for example steel strip, and is described primarily in that context hereinafter. However, it will be apparent that the invention is applicable to the application of other liquid or semi-liquid coatings to substrates or strip other material, provided that the substrate or strip is substantially impervious to the coating.

BACKGROUND OF THE INVENTION

The large scale application of paint to substrates such as steel strip in continuously operating, steel finishing mills is a highly developed art but has been restricted hitherto to the production of mono-chrome product, wherein a uniform coating is applied to the whole of at least one side of the strip. Such an application is disclosed in EP-494672.

The present invention overcomes that limitation of the prior art, and provides for the continuous, simultaneous application of different coatings to each of two, contiguous, longitudinally extending zones of the strip.

DISCLOSURE OF THE INVENTION

The applicants have found that if two closely adjacent but noncontiguous beads of liquid or semi-liquid coating material are maintained in an upstream nip defined by a moving strip and a doctor roll extending transversely of the strip, then a steady state condition may be attained such that the strip emerging downstream of the roll is coated with coatings respectively derived from each bead and those coatings are in contact with each other but without substantial intermingling. Furthermore, the junction line between the emergent coatings may be straight and fixedly positioned on the strip. Thus, if two beads of similar, but differently coloured, paint compositions are so maintained, the result is a neatly striped product.

According to one aspect of the invention, there is provided a method of coating a strip including the steps of moving the strip to be coated through a smoothing device including a doctor roll to form an upstream nip between the strip and the doctor roll, positioning at least one stationary partition means to divide said nip into at least two closely adjacent nip lengths, and depositing coating materials on the strip upstream of said smoothing device for delivery into the respective nip lengths at rates which maintain a bead of coating material in each nip length; a stripe of coating material being formed from each nip length on said strip as the strip passes through the nip.

It is preferable that the coating materials are liquid or semi-liquid when deposited on the strip and the coating materials delivered into each nip length preferably have different physical characteristics.

The reference to the coating materials having different characteristics includes coating materials having different colours.

In preferred embodiments, boundary means similar to said partition means may be provided at each edge of the strip. These boundary means may be immediately adjacent the strip, that is to say they may contact the respective edges of the strip passing between them, or they may overlie and contact narrow edge margins of the strip. In the latter case the boundary means may have a width about equal to half that of the, or each, partition means.

In preferred embodiments, the deposition rates of the coating materials are selected and controlled to ensure that the individual beads of coating material in the respective nip lengths have substantially constant volumes under steady state operation. This requires the deposition rate for each nip length to substantially equal the rate at which material escapes from each nip length. When the doctor roll pressure is set to product coating of desired thickness and there is just sufficient spreading of the material escaping from each nip length by the doctor roll to produce a continuous uninterrupted downstream coating.

When the respective coating compositions are of substantially the same viscosity, the individual beads are not only substantially constant in steady state volume but are also substantially equal in steady state volume per unit nip length. This further facilitates the formation of a coating of desired thickness without interruption or interference at the junction or junctions of the stripes.

The equality is expressed on a volume per unit nip length basis because the invention is applicable to instances in which the individual stripes differ in width, and hence are produced from nip lengths of differing sizes so as to produce different aesthetic effect in the finished product.

The width of the partition means is dependant on the viscosity or spreading characteristics of the coating material in the strip. Where the individual coating compositions have different viscosities or different spreading characteristics, it may be desirable to use partition means or different widths (as measured in the axial direction of the doctor roll), between different pairs of neighbouring nip lengths.

In another aspect of the invention there is provided an apparatus for producing a striped coating on a continuously moving strip, including a smoothing device including a doctor roll forming a nip with strip at least one stationary partition means in the nip dividing said nip into at least two closely adjacent nip lengths, and means upstream of said smoothing device to deposit coating materials on the strip for delivery into the respective nip lengths at predetermined rates said deposit means maintaining a bead of coating material in each nip length, a stripe of coating material being formed from each nip length on said strip as the strip passes through said nip.

In preferred embodiments, when the strip may withstand being heated to temperatures above either the glass transition temperatures or melting points of the coating materials as the case may be, the means to deposit the liquid or semi-liquid coating materials may be melt depositors of the kind which drive a block of substantially solid coating material towards the heated strip at a predetermined speed to cause liquid or semi-liquid material to be melted from the block and deposited on the strip. Such melt depositors are described in our Australian patent No. 667716 and our co-pending International patent application no. PCT/AU97/00555 filed Aug. 28, 1997 entitled "Apparatus and method For Block Feeding" the whole contents of which are hereby incorporated by reference. Such melt depositors are preferred because of the precise control they provide over the deposition rate. They also readily permit deposition onto chosen zones of the strip, to facilitate the feed of the individual deposits to the respective nip lengths.

BRIEF DESCRIPTION OF THE DRAWING

By way of example an embodiment of the above described invention is described in more detail hereinafter with reference to the accompanying drawings.

DETAILED DESCRIPTION

Figure 1:
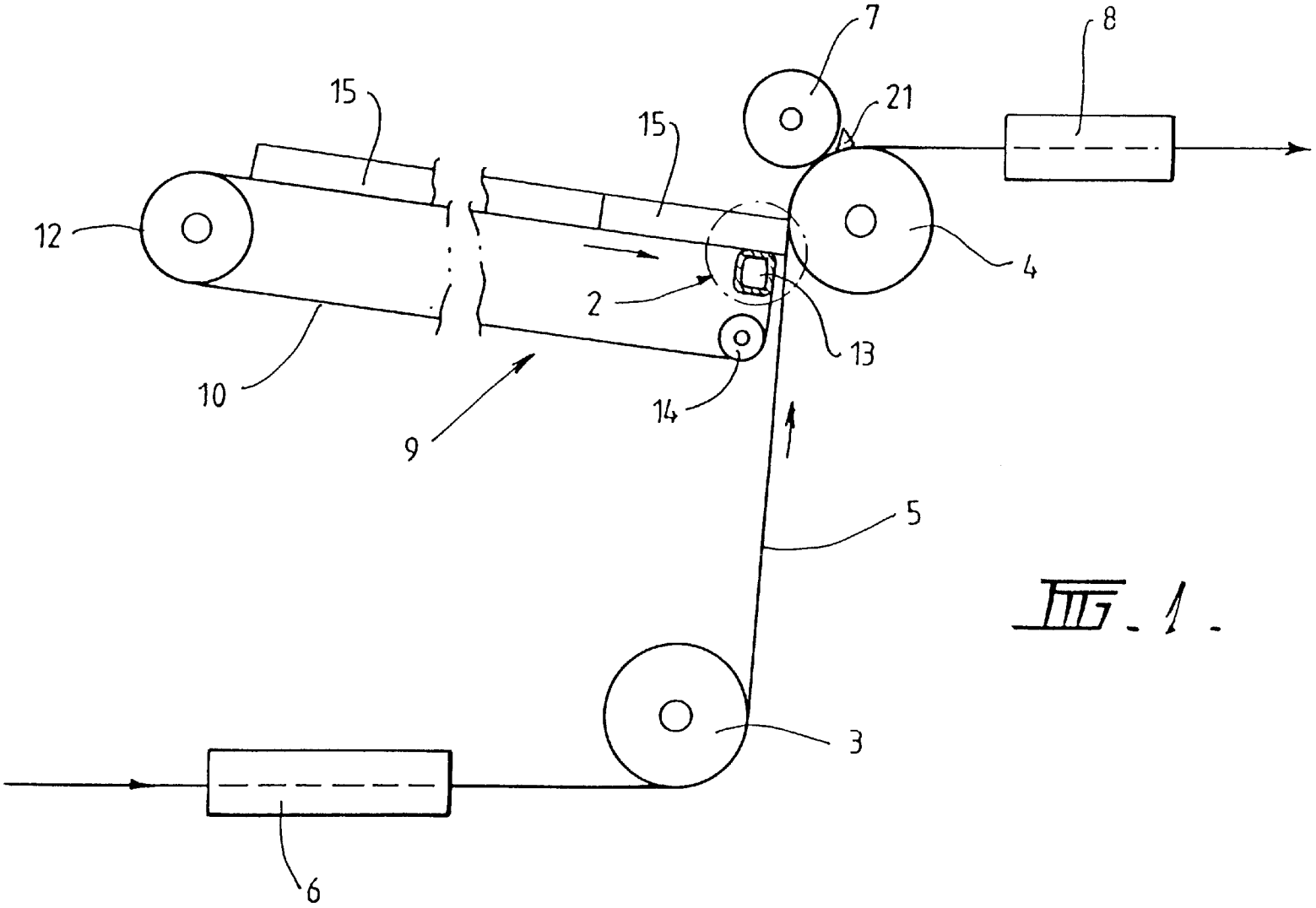
FIG. 1 is a diagrammatic, not to scale, side elevation of a continuous strip melt deposition painting apparatus including a smoothing device in accordance with the invention.
Figure 2:
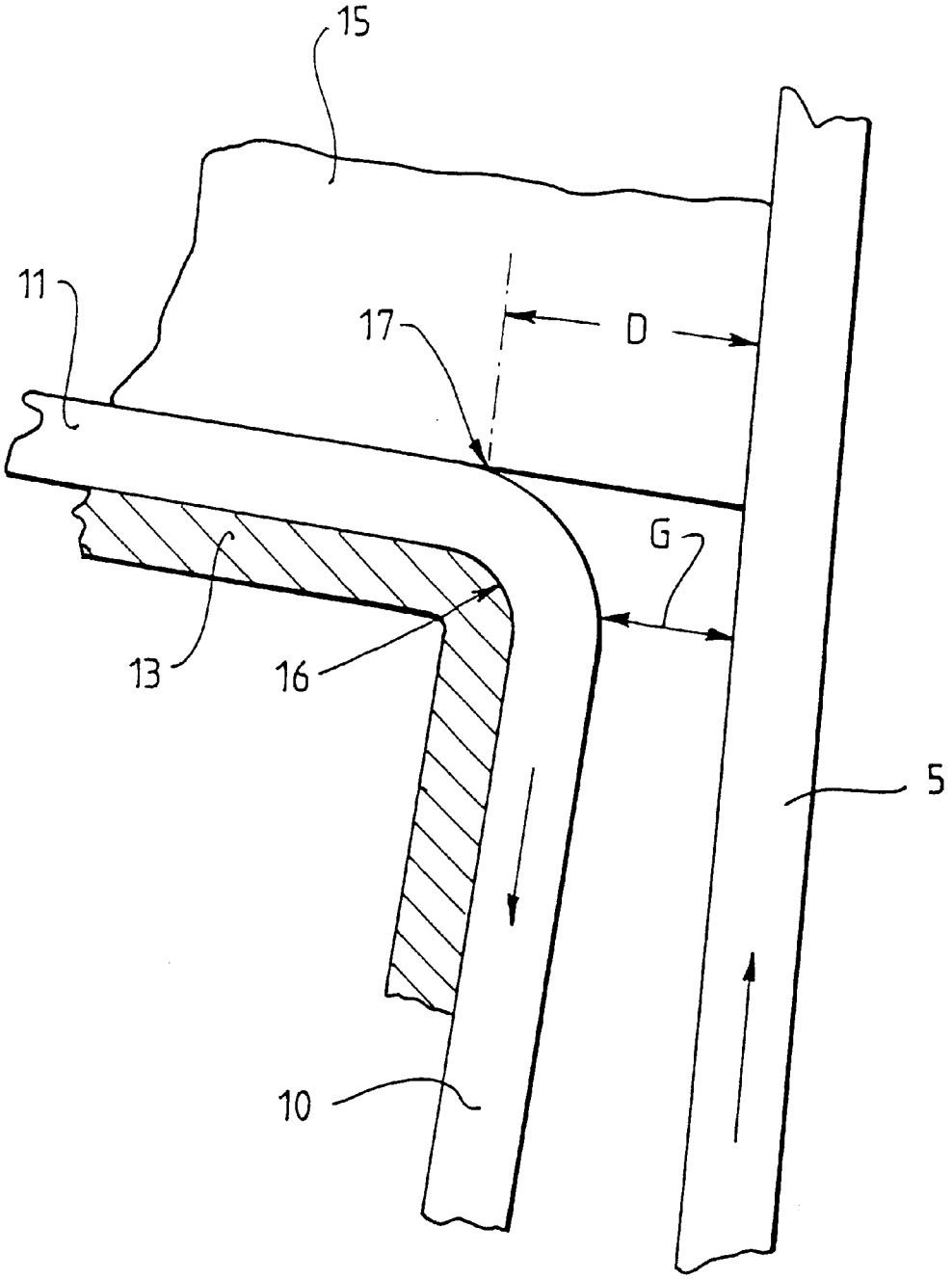
FIG. 2 is a greatly enlarged detail of a part of FIG. 1 within the enclosure marked 2 in that Figure.

The illustrated painting apparatus shown in FIG. 1 includes turning roll 3 and support roll 4 whereby a strip 5 to be painted is guided through a melt deposition station. The apparatus also includes a strip preheating furnace 6 whereby the strip 5 is brought to a temperature above the glass transition temperature of the solid paint composition to be melt deposited onto the strip. The apparatus further comprises a device for spreading and smoothing the paint, including an elastomeric roller 7, and a curing furnace 8 for use in those instances when the paint composition is thermosetting in nature.

The apparatus described in the above paragraph is in accordance with the invention proposed in the earlier mentioned Australian Patent No. 667716, and International patent application no. PCT/AU97/00555 filed Aug. 28, 1997 and entitled "Apparatus and method for Block Feeding", the whole contents of which are herein incorporated by reference, and that earlier described apparatus could be used with any known block feeding means for melt depositing liquid paint composition on the strip at the deposition station.

In the apparatus shown in FIG. 1, the apparatus for block feeding or depositing the coating material on the heated strip includes conveyor means shown as an endless belt conveyor 9 comprising a belt 10, including a substantially planar flight 11, riding around a head pulley 12 and turn round means comprising a stationary guide 13 and an idler pulley 14.

The head pulley 12 is driven by a motor and drive transmission (not shown) such that the speed of rotation of the head pulley may be accurately set at any desired value within a range of values.

The belt flight 11 is adapted to support a file of at least two blocks 15 of substantially solvent free paint composition. To that end the flight 11 may slide upon a supporting table, in which event the stationary guide of the turn round means may be no more than the end edge of that table.

In the embodiment shown, the guide 13 is a beam of standard, hollow rectangular section spanning the full width of the belt. As such, it presents a small radius, longitudinal corner 16 around which the belt 10 turns as it departs from the plane of the flight 11 at the termination 17 of the flight 11. After the turn round, the belt proceeds in a direction which is either parallel with or diverging from the face of the strip to be painted or coated.

The head pulley 12 is preferably surfaced with a high friction material such as natural rubber. It is preferably mounted on a slidable saddle or the like that is continuously urged away from the turn round means by an adjustable loading spring or the like. These arrangements provide slip free drive transmission between the head pulley 12 and the belt 10, so that the flight 11 advances towards the strip 5 at a predetermined speed set by the rotational speed of the pulley. In other embodiments the surface of the belt contacting the head pulley may be transversely ribbed or toothed and the pulley surface may be correspondingly recessed to provide a positive drive connection therebetween.

The belt 10 is made of a pliable, heat resistant, durable material. It may, for example, be a fluorinated polymer reinforced with a woven fabric of, for example, glass fibres. The belt surface in contact with the blocks 15 is preferably smooth.

Thermosetting paint compositions in block form tend to adhere to most surfaces, and the belt material referred to in the previous paragraph is certainly one such surface. This results in a high friction contact between the belt 10 and the blocks 15 so that the control of the belt speed translates into control of the block speed, as needed for control of the melt deposition rate.

Figure 3:
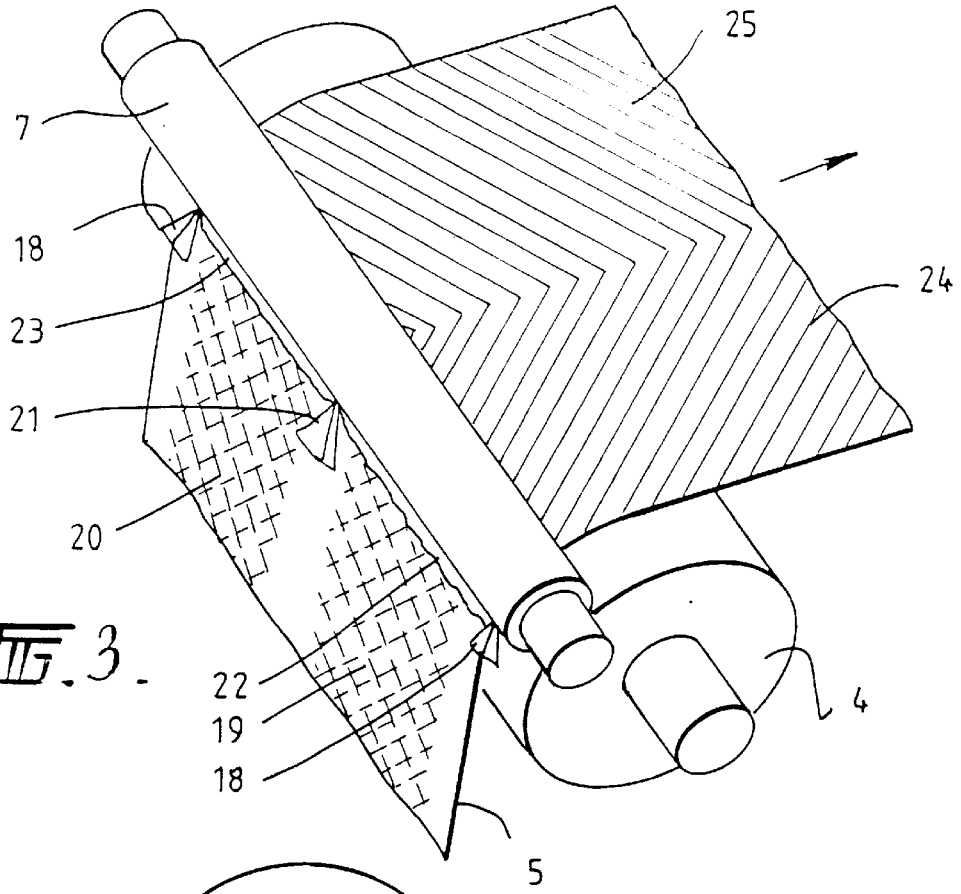
FIG. 3 is an enlarged diagrammatic perspective view of a strip passing through the smoothing device shown in FIG. 1.
Figure 4:
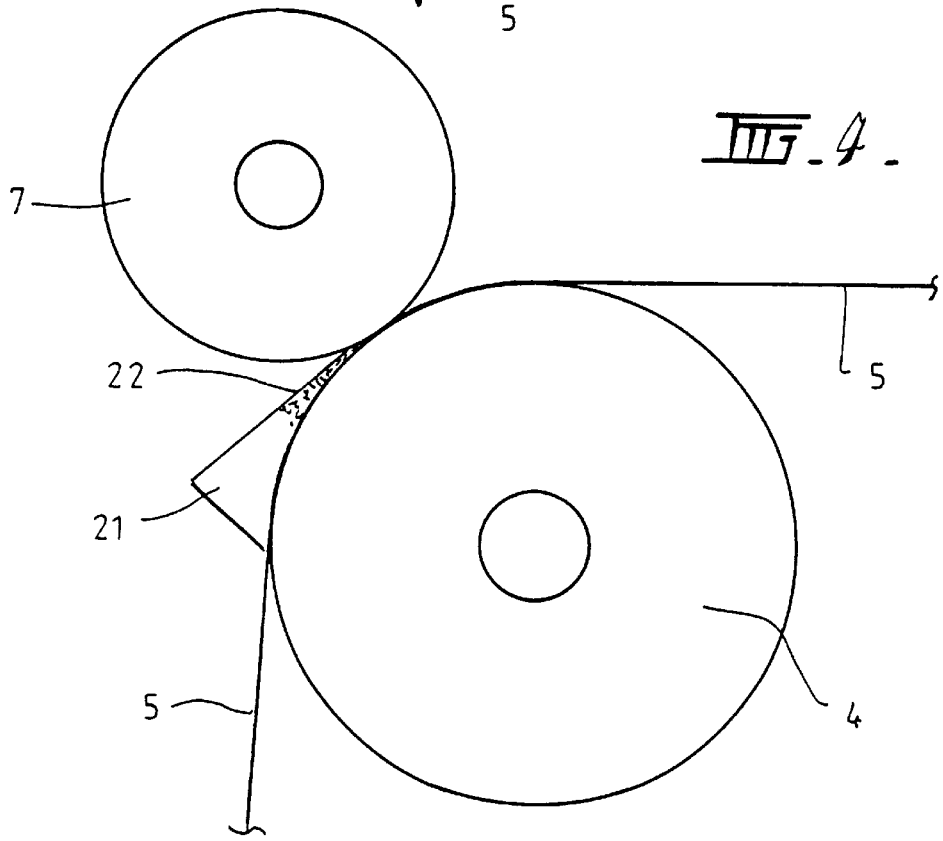
FIG. 4 is an end view of the subject matter of FIG. 3 drawn to a larger scale.

The illustrated smoothing device in accordance with the invention and shown in FIGS. 1 and 3, may be included as a component of a continuous paint line in a steel strip finishing mill. The invention includes a conventional, steel, support roll 4 and a conventional smoothing doctor roll 7 with an elastomeric outer cylindrical surface layer. A steel strip 5 is supported by and passes over the support roll 4. Both rolls are power driven and their surface speeds are not necessarily the same. The support roll 4 is driven so that its surface speed is substantially the same as that of the strip 5, and that part of the roll touching the strip moves in the same direction as the strip. On the strip. On the other hand the surface speed of the smoothing doctor roll 7 may range between a slow speed in the opposite direction to the movement of the strip, through zero up to about 25% of the speed of the strip in the same direction as the speed of the strip. A pressure is maintained between the rolls and the strip sufficient to bring about the necessary spreading of the coating material escaping from each nip length.

In the embodiment of the invention, it is preferable to use a melt depositor upstream of the smoothing device including a tandem block feeder whereby two or more block supporting flights are positioned one above the other separated by a distance greater than the thickness of the paint blocks or in side-by-side arrangement across the width of the moving strip as is shown throughout the several drawing figures. The tandem block feeder deposits differently coloured, solvent free, liquid paint compositions, indicated by the broken cross-hatchings 19 and 20, onto a side of the strip. The deposits 19 and 20 are relatively rough and patchy but they are deposited at very precise deposition rates. It will be seen that the deposits do not fully cover the side of the strip, but rather are laid down on two spaced apart longitudinal zones that are also spaced from the edges of the strip. Thus the melt depositing means either comprise two separate units, one for each paint block, or are adapted to drive two spaced apart blocks simultaneously at the same speed for each.

A single partition means comprising a still lamina 21 of, for example, Teflon or other heat resistant, non-stick material divides the upstream nip defined by the strip 5 and smoothing doctor roll 7 into two nip lengths separated by the width of the lamina 21. The lamina 21 is held stationary by any suitable holding means (not shown) spanning the strip 5. It is shaped with a cusp at one end fitting neatly into the nip, as far as possible without fouling the roll 7.

In this regard it must be realised that the roll 7 is compressed by the pressure between it and the thin liquid layer on the strip 5 passing through the nip to the downstream side. Thus the tip of the cusp of the lamina 21 is spaced a small distance upstream of the notional plane in which the axes of both rolls lie.

Boundary means 18 may be provided at each edge of the strip. The boundary means may be immediately adjacent the strip, that is to say they may contact the respective edges of the strip 5 passing between them, or they may overlie and contact narrow edge margins of the strip. In the latter case, the boundary means may have a width about equal to half that of the, or each partition means.

At start up, two beads 22 and 23 of the respective coating materials build up in each nip length. Material from each nip length enters the contact zone between the roll 7 and the strip 5. The roll then spreads that material so that the material from each bead covers a section of the strip. This spreading slightly reduces the average thickness of the layer of material and enables the roll 7 to produce a desirably smooth coating, comprising two stripes 24 and 25 respectively.

Examples of possible arrangements of tandem block feeders of melt depositors are illustrated in FIGS. 5–8.

The two or more flights may operate in unison (ie. slide together on a common supporting table) and operate at the same time. When the conveyor means are an endless belt, the head pulleys of each flight is able to operate independently of the other so that the speed of rotation of the belts may be the same or varied. It may also be desirable for the flights to slide on the support table independently.

Figure 5:
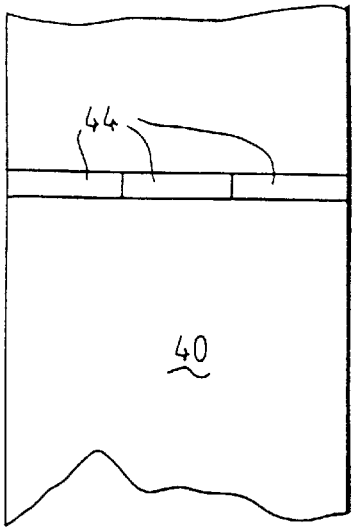
FIGS. 5, 6, 7 and 8 illustrate effective multiple feeding arrangements for a melt depositor.
Figure 7:
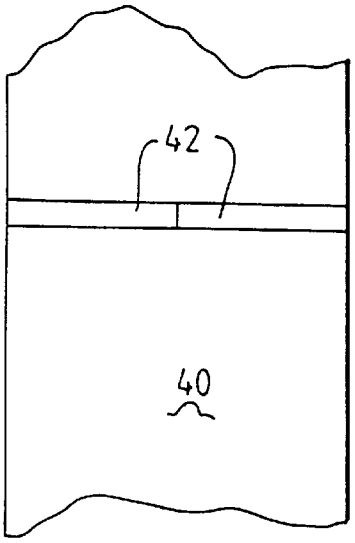

FIG. 5 shows the conveyor arrangement of the tandem melt depositor when two blocks 42 of coating material are used to coat the slip and FIG. 7 shows a conveyor arrangement for three blocks 44. The number of conveyors is preferably equal to the number of blocks of coating material used.

Figure 6:
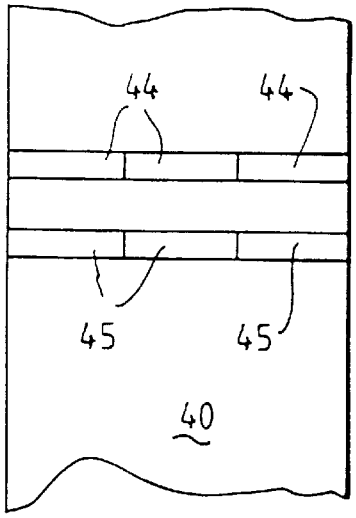
Figure 8:
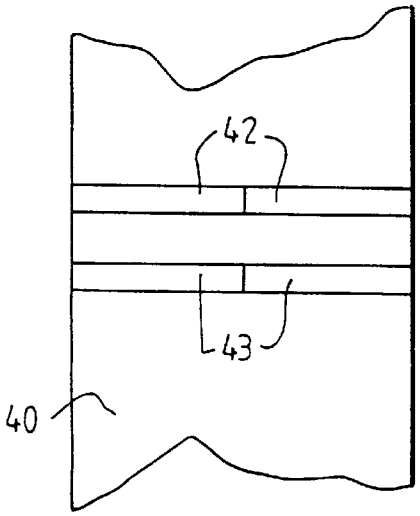

In FIGS. 6 and 8, if the flights upon which the blocks travel are able to slide independently of each other, then the blocks 44, 42 on the top flight shown in FIGS. 6 and 8 can be moved in and be painting in one combination of colours while the blocks 45, 43 on the bottom flight can be loaded with a second combination of colours ready to paint when the first colour combination is no longer required. Hence the top flight can be retracted while the bottom flight is moved into the painting position to start painting and increase the speed with which the colour to be applied to the strip can be changed.

What is claimed is:

1. A method of coating an exterior surface only of a strip which is substantially impervious to the coating, including the steps of moving the strip to be coated through a smoothing device including a doctor roll to form an upstream nip between the strip and the doctor roll, positioning at least one stationary partition means to divide said nip into at least two nip lengths disposed on opposite sides of said partition means, and depositing coating materials on the strip upstream of said smoothing device for delivery into the respective nip lengths at rates which maintain a bead of coating material in each nip length; a stripe of coating material being formed from each nip length on said strip as the strip passes through the nip.

2. The method of claim 1 wherein the coating materials are liquid or semi-liquid when deposited on the strip.

3. The method of claim 2 wherein the coating materials delivered into each nip have different physical characteristics.

4. The method of claim 3 wherein the different characteristics includes the coating materials having different colors.

5. The method of claim 1 wherein the at least two nip lengths are non-contiguous.

6. The method of claim 5 wherein the deposition rates of the coating materials are controlled to provide individual beads of coating material of substantially constant volume in the respective nip lengths under steady state operation.

7. The method of claim 6 wherein the deposition rate for each nip length is substantially equal to the rate at which coating material is spread at each nip length.

8. The method of claim 7 wherein the viscosities of the respective coating materials are substantially the same.

9. The method of claim 8 wherein during operation the respective volumes per unit nip length of the individual beads are substantially equal.

10. The method of claim 7 wherein the nip is divided into nip lengths of different size.

11. The method of claim 5 wherein the smoothing device further includes a support roll, the strip passing over and being supported by said support roll.

12. The method of claim 11 including the further step of maintaining a sufficient pressure between the support roll and the doctor roll to spread the coating material escaping from each nip length.

13. The method of claim 1 wherein the coating material is deposited on the strip with a melt depositor.

14. The method of claim 13 further including the step of preheating the strip, and wherein the melt depositor moves at least two blocks of substantially solid coating material towards the heated strip at a predetermined speed to cause liquid or semi-liquid material to be melted from the blocks and deposited on the strip.

15. The method of claim 14 wherein the melt depositor includes at least two tandem conveyors extending across the width of the strip, the number of conveyors corresponding to the number of blocks, said conveyors moving the blocks towards the heated strip.

16. The method of claim 15 wherein each conveyor is operated independently of other conveyors.

17. An apparatus for producing a striped coating, on an exterior surface only, of a continuously moving strip which is substantially impervious to said coating, including a smoothing device including a doctor roll forming a nip with the strip, at least one stationary position means in the nip dividing said nip into at least two nip lengths disposed on opposite sides of the partition means, means upstream of said smoothing device to deposit coating materials on the strip for delivery into the respective nip lengths at predetermined rates, wherein said deposit means is a melt depositor, wherein said melt depositor maintains a bead of coating material in each nip length, said coating material being liquid or semi-liquid when deposited on the strip, a stripe of coating material being formed from each nip length on said strip as the strip passes through said nip, and a strip heater through which the strip passes prior to encountering said melt depositor.

18. The apparatus of claim 17 wherein the smoothing device further includes a support roll, the strip passing over and being supported by said support roll.

19. The apparatus of claim 18 wherein pressure is maintained between the support roll and the doctor roll to spread the coating material escaping from each nip length.

20. The apparatus of claim 18 wherein the melt depositor moves at least two blocks of substantially solid coating material towards the heated strip at a predetermined speed to cause liquid or semi-liquid material to be melted from the blocks and deposited on the strip.

21. The apparatus of claim 20 wherein the melt depositor includes at least two tandem rows of conveyor extending across the width of the strip, the number of conveyors corresponding to the number of blocks of substantially solid coating material, each row of conveyors being operated independently of any other conveyor.

22. The apparatus of claim 17 wherein boundary means are provided at each edge of the strip.

23. The apparatus of claim 22 wherein the boundary means overlie and contact edge margins of the strip.

24. The apparatus of claim 22 wherein at least two stationary partition means are provided.

* * * * *